United States Patent [19]

Hill

[11] 4,366,805

[45] Jan. 4, 1983

[54] SECTOR CONTROL WOOD-TYPE FUEL BURNING FURNACE

[75] Inventor: Richard C. Hill, Orono, Me.

[73] Assignee: Board of Trustees of the University of Maine, Bangor, Me.

[21] Appl. No.: 257,327

[22] Filed: Apr. 24, 1981

[51] Int. Cl.[3] ..... F23L 3/00

[52] U.S. Cl. ..... 126/285 R; 126/99 R; 126/112; 126/344

[58] Field of Search ..... 126/99 R; 111, 101, 126/108, 112, 307 R, 307 A, 285 R, 289, 292, 344, 77, 34, 116 R; 110/208, 295, 147, 162, 163

[56] References Cited

U.S. PATENT DOCUMENTS

| | | | |
|---|---|---|---|
| 394,355 | 12/1888 | Gillingham | 126/285 R |
| 574,479 | 1/1897 | Egle | 126/285 R |
| 771,420 | 10/1904 | Cooper | 126/111 |
| 990,755 | 4/1911 | Lembke | 126/116 R |
| 1,224,700 | 5/1917 | Atherton | 126/116 R |
| 2,104,096 | 1/1938 | Paradise | 126/99 R |
| 2,742,896 | 4/1956 | Schack et al. | 126/99 R |
| 4,160,440 | 7/1979 | Barnickle | 126/285 R |
| 4,195,617 | 4/1980 | Scopetti et al. | 126/34 |
| 4,309,965 | 1/1982 | Hill | 126/361 |

*Primary Examiner*—Daniel J. O'Connor
*Attorney, Agent, or Firm*—Daniel H. Kane, Jr.

[57] ABSTRACT

A wood furnace permits controlled combustion of sectors or segments of wood-type fuels for a high turn down ratio. The primary combustion chamber comprises a refractory base portion for high temperature combustion and an upper portion with a water jacket in heat exchange relationship with the upper portions of the fuel for quenching combustion. A plurality of refractory secondary combustion channels or a single laterally extending or distributed secondary channel leads away from the refractory base portion of the primary combustion chamber. The secondary channels or distributed channel conduct flue gases from different sectors of the fuel, and permit completion of combustion in a high temperature environment. A plurality of flue draft pathways lead from the secondary combustion channels or distributed channel for transfer of heat from the end products of combustion to a heat transfer medium. Separate dampers are provided for controlling the draft in the separate flue draft heat exchange pathways. This permits separate control over combustion of different sectors of the fuel. By appropriate permutations and combinations of control of the flue gas outlets, the rate of combustion and heat output of the furnace may be varied and controlled without sacrificing efficiency of the completeness and intensity of combustion.

25 Claims, 10 Drawing Figures

SECTOR CONTROL WOOD-TYPE FUEL BURNING FURNACE

FIELD OF THE INVENTION

This invention relates to furnaces and stoves for high temperature efficient and clean combustion of wood-type fuels. The invention is particularly concerned with controlled combustion of wood-type fuels for both central heating furnaces and decentralized lower intensity applications requiring a high turn down ratio.

BACKGROUND OF THE INVENTION

In U.S. patent application Ser. No. 075,815 now U.S. Pat. No. 4,309,965 there is described a new wood fuel combustion system developed by Professor Richard C. Hill of the University of Maine at Orono and assigned to the Board of Trustees of the University of Maine. According to the system developed by Professor Hill and described in patent application Ser. No. 075,815, burning of wood fuel for heating purposes is accomplished first by combustion of wood-type fuel in a high temperature (e.g. 1200°-2000° F.) (650° C.-1100° C.) refractory environment; second by delayed propagation of the flue gases in a continuing high temperature refractory insulating environment to assure complete combustion; and third, only after completion of combustion, by extraction of heat from the end products of such combustion. Integrally combined with this system is an air tight chamber arrangement for vertically feeding wood-type fuel into the high temperature refractory environment while confining the locus of combustion to the base of the fuel only. This is achieved by a water jacket or water environment around the upper portion of the combustion chamber which quenches ignition of wood in the portion of the fuel over the locus of combustion. Combustion is therefore confined to the bottom of the fuel at the base of the chamber. The flue gas is laterally drafted away for a controlled steady state burn of the charge of fuel placed in the air tight chamber. The water jacket arrangement moreover is a coacting element of the water system cooperating with the heat exchanger and downstream elements for extracting heat. Yet the purpose of the water jacket arrangement is not only heat extraction but also confinement of combustion and controlled burning.

According to the Hill disclosure in Ser. No. 075,815, now U.S. Pat. No. 4,309,965, a substantially vertical feed combustion chamber forming an upright column receives and supports wood-type fuel in a substantially vertical attitude or stack. The combustion chamber is substantially air tight and formed with a laterally directed draft outlet at the base of the combustion chamber.

Hill also provides a flue gas delay propagation channel extending from the laterally directed draft outlet at the base of the combustion chamber, and a heat exchanger coupled to the output of the flue gas delay channel for receiving the hot gaseous end products of wood combustion and transferring heat from the gases to the water or other medium. The flue gas propagation channel affords delayed propagation of the flue gas and forced air mixture in a high temperature refractory environment sufficient to afford substantially complete secondary burning of the gaseous products and constituents of wood burning and all prior to heat transfer in the heat exchanger. The water jacket and heat exchanger form elements of a common water or heat transfer fluid environment.

Hill also provides an induced draft from the base of the combustion chamber through the delayed propagation channel and heat exchanger for laterally directing the draft away from the locus of wood fuel combustion and away from the vertically stacked charge of fuel. In addition to actively inducing the draft, the disclosed system actively forces air into the combustion chamber base portion to effect turbulent mixing and swirling of air with the gaseous products of wood fuel pyrolysis. A turbulent mixture of air and fuel gas therefore follows the draft from the base of the combustion chamber through the laterally directed channel where the travel time in a high temperature environment permits substantially complete secondary burning of the flue gases. Heat exchange following the chemical reaction phase thereafter affords low stack temperatures.

There is therefore, according to Hill, a cooperating water jacketed or water circulating environment at one level and high temperature refractory insulating environment at another level. There is controlled coupling between the levels with wood fuel passing from the higher heat exchanging water level environment to the lower refractory insulating level. There is passage of products of completed secondary combustion from the heat confining lower refractory environment back through the heat transferring water level environment. There is vertical feed of wood with confinement of combustion to the refractory level and there is delayed propagation of flue gas through the refractory level for complete combustion before return through the water level environment.

A limitation of the wood-type fuel burning system described by Professor Hill in Ser. No. 075,815 now U.S. Pat. No 4,309,965 is that the rate of fuel combustion is constant throughout the burn of a charge of fuel. The rate of fuel combustion may not be "turned down," and the furnace burns at capacity until the charge of wood is consumed. While this results in complete and efficient combustion, the rapidly produced high intensity heat energy must be conducted away as quickly and stored. Thus, the furnace can generally not be used directly as a space heater or in other direct applications requiring low impedance, low intensity heat energy.

OBJECTS OF THE INVENTION

It is therefore an object of the present invention to provide a wood-type fuel burning furnace affording high temperature, efficient and clean combustion of fuel, yet which also permits a high turn down ratio without sacrificing high temperature, efficiency or completion of the burn. The present invention thus is intended for application both as a central heating furnace and for direct decentralized, lower intensity, lower output applications.

Another object of the invention is to provide an efficient furnace which can burn a large charge of wood-type fuel in small increments at different locations of the fuel load without shifting the fuel. Thus, the invention provides controlled burning of sequential sectors of a wood-type fuel in the primary combustion zone.

A feature and advantage of this arrangement is that small sectors or segments of a relatively large fuel charge may be burned incrementally at high temperature, efficiently and cleanly without having to burn the entire base of the fuel at once. The invention therefore seeks to provide the high turn down ratio by controlling the scope of the burn within the fuel load while still employing the advantageous features of the high efficiency would furnace system developed by Professor Hill at the University of Maine at Orono.

It is a further object of the invention to provide sequential burning of wood-type fuel according to a variety of combustion chamber configurations in order to accommodate wood-type fuels of different form.

SUMMARY OF THE INVENTION

In order to accomplish these results, the present invention provides a furnace for controlled combustion of sectors or segments of wood-type fuels in a primary combustion chamber. The primary combustion chamber comprises a refractory base portion for high temperature combustion and an upper portion with a water jacket in heat exchange relationship with the fuel in the chamber. The surrounding water jacket or water environment conducts away heat, quenching combustion in the upper portion of the primary combustion chamber.

According to the invention a plurality of refractory secondary combustion channels or a single laterally extending or distributed secondary channel leads away from the refractory base portion of the primary combustion chamber. The secondary channels or distributed channel afford a high temperature secondary combustion environment for conducting flue gases from different sections or sectors of the fuel in the primary chamber. The secondary channels delay propagation for a sufficient period to permit completion of combustion. A plurality of flue draft pathways lead from the secondary combustion channels or distributed channel for transfer of heat from the end products of combustion to the heat transfer medium.

A feature and advantage of this arrangement is that the draft through the separate flue draft heat exchange pathways may be separately controlled. This in turn permits sector control of combustion of fuel loaded in the primary combustion chamber through the secondary combustion channels or distributed channel. Sequential burning of controlled sectors of the fuel affords the high turn down ratio of the present invention. Furthermore, the separate damper control of the different flue draft pathways may be motorized and under the control of a timer or other controller for automated sequential sector burning at a high turn down ratio.

The invention contemplates a variety of configurations for the primary combustion chamber, secondary combustion channels, and flue draft pathways. According to one embodiment, a primary combustion chamber of circular cross-section or cylindrical shape permits radial sector control of the fuel combustion. Refractory secondary combustion channels extend radially away from the periphery of the refractory base portion of the central primary combustion chamber. The channels may lead to an annular refractory combustion zone coaxially around the primary zone. A separate flue gas pathway, such as, for example, a metal flame tube, corresponding to each sector, extends from the annular combustion zone through the water jacket or other heat transfer medium environment surrounding the upper portion of the combustion chamber.

The invention also contemplates linear sector control of fuel combustion with sequential burning of fuel sectors along a linear sequence in an elongate bed of wood-type fuel. For example, the combustion chamber may accommodate a stack of horizontal logs which feed by gravity into the locus of combustion with sector control along the base of the fuel. Secondary combustion channels and flue gas pathways distributed along the sides of the refractory base portion of the elongate bid permit separate sector control in a linear sequence.

Induced draft and forced air are also provided along with additional features and advantages apparent in the following specifications and accompanying drawings.

DETAILED DESCRIPTION OF THE PREFERRED EXAMPLE EMBODIMENTS

Figure 1:
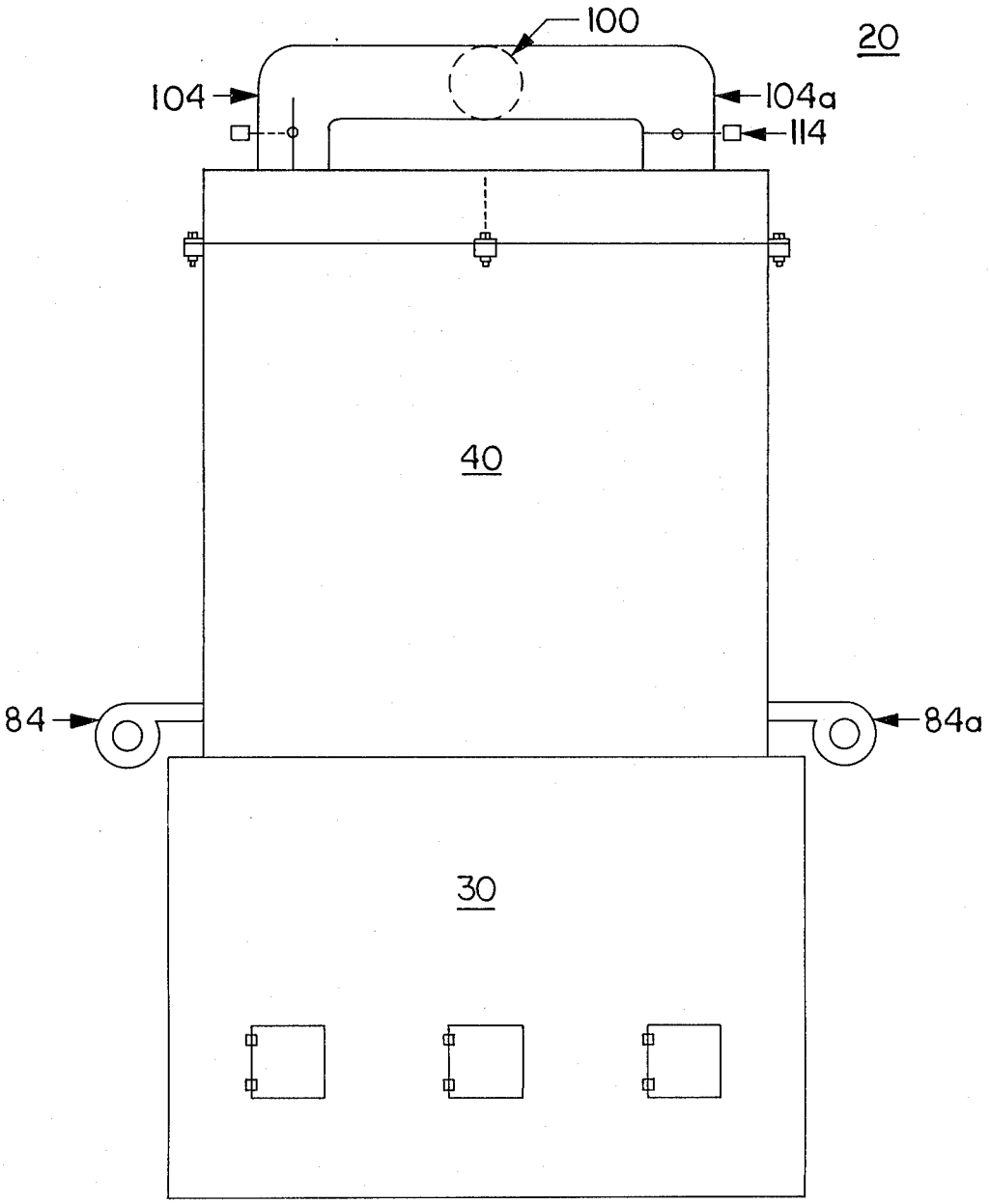
FIG. 1 is a front view and FIG. 2 is a side view of a controlled combustion furnace of rectangular configuration for sector control of burning of wood-type fuels in accordance with the present invention and showing the lower level refractory environment 30 and the upper level heat transfer environment 40.

In the embodiment of the present invention illustrated in FIGS. 1 through 5 there is shown a furnace 20 of rectangular configuration. The furnace 20 includes a first level or lower level 30 forming a refractory high temperature insulating environment, and a second level or upper level 40 forming a relatively lower temperature heat transfer environment. The lower level refractory high temperature environment 30 defines a primary combustion zone or chamber 50 and secondary combustion zones 60 which include flue gas propagation delay channels or holding channels 70 distributed around the primary combustion zone. The upper level heat transfer environment 40 includes a quenching zone 80 through which fuel feeds into the primary combustion zone 50, and a heat exchange zones 90 through which the substantially completely combusted flue gas passes from the secondary combustion zone 60 to the chimney outlet 100. A heat transfer medium circulates through the heat transfer environment 40 for effecting quenching of fuel stacked in zone 80 above the primary combustion chamber 50. This medium also extracts heat in zone 90 from the end products of combustion passing from the secondary combustion zone 60 through the heat exchanger to the chimney outlet 100.

Figure 2:
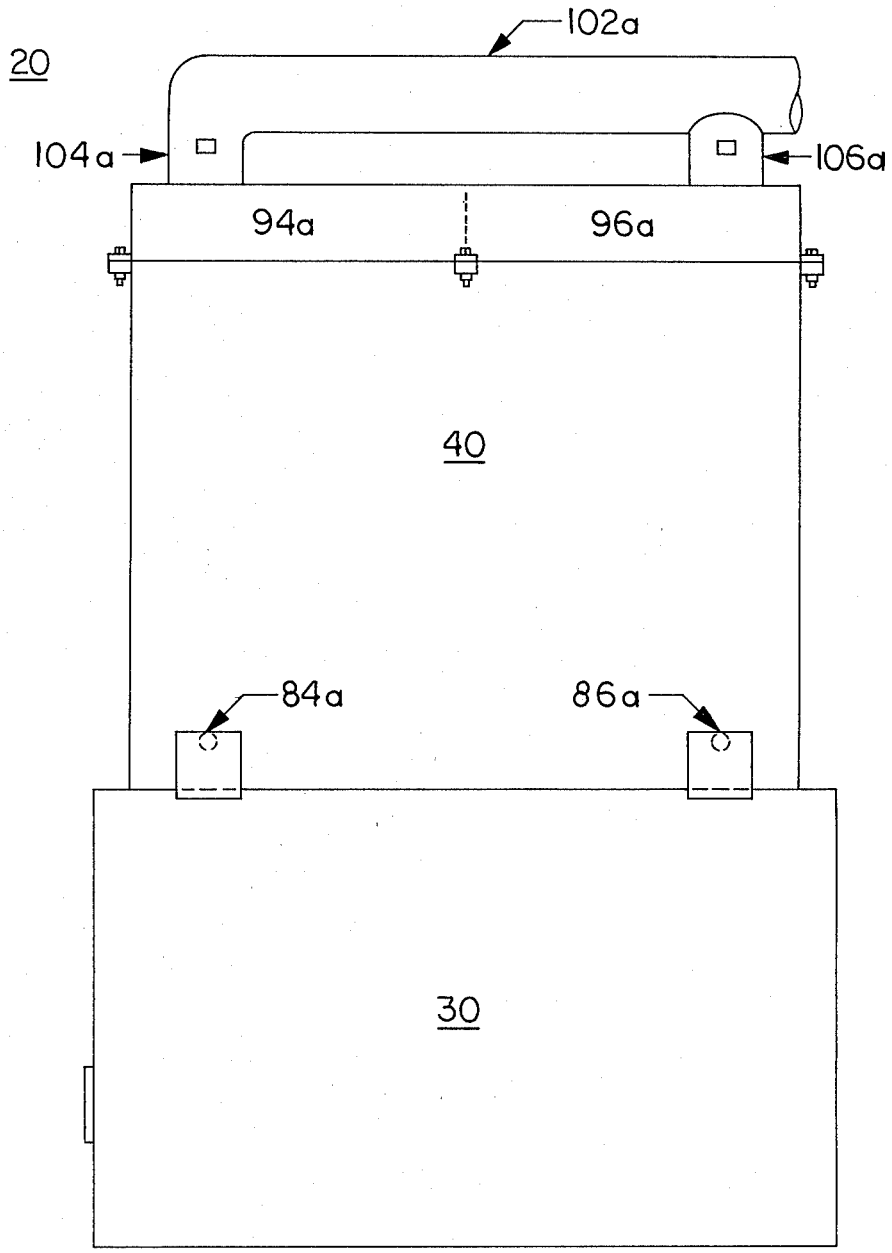
Figure 3:
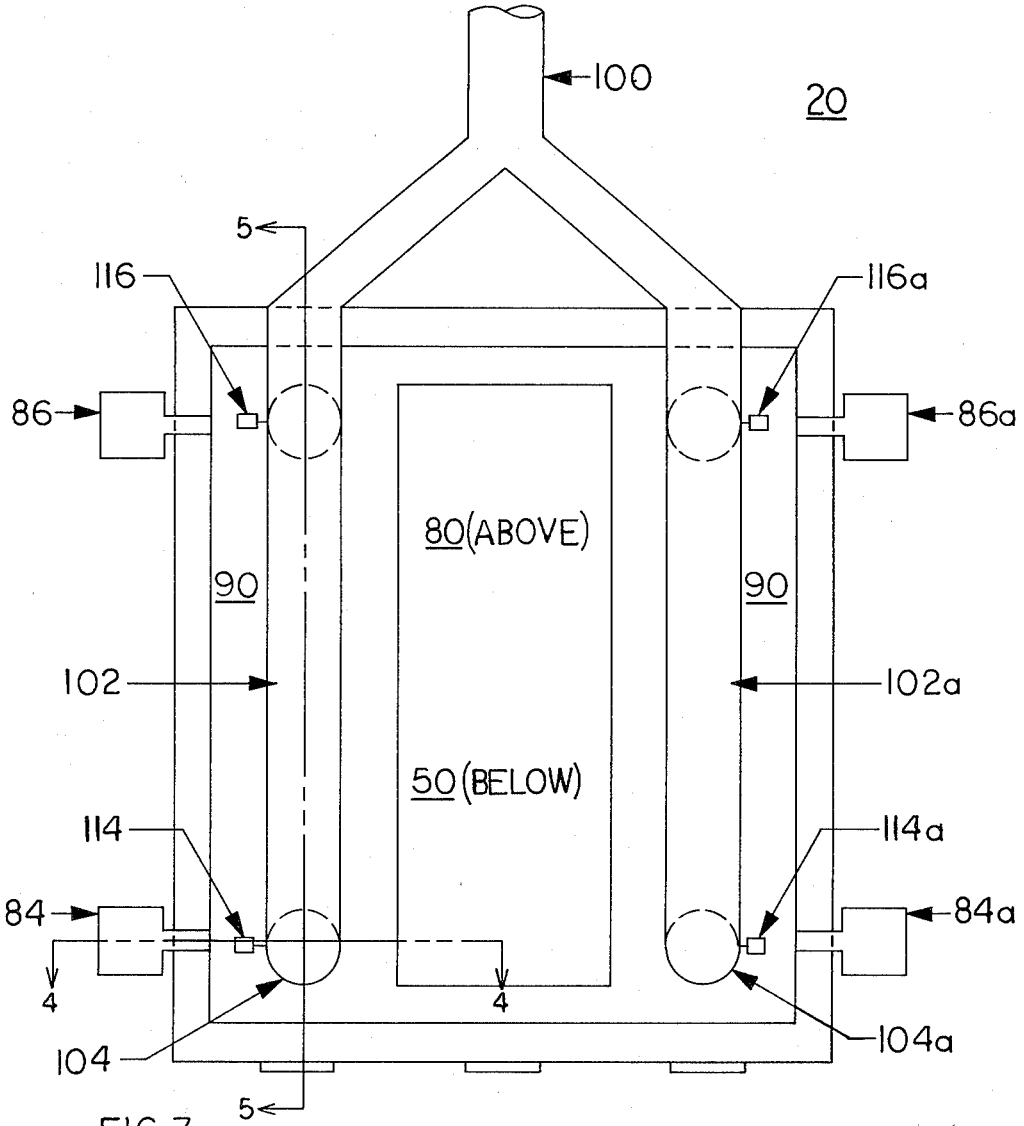
FIG. 3 is a plan view of the furnace from above showing the central location of the primary combustion zone and the quenching zone 80 with sector controlled drafting from the sides through the secondary combustion zone and the heat exchange zone 90 as hereafter described.
Figure 4:
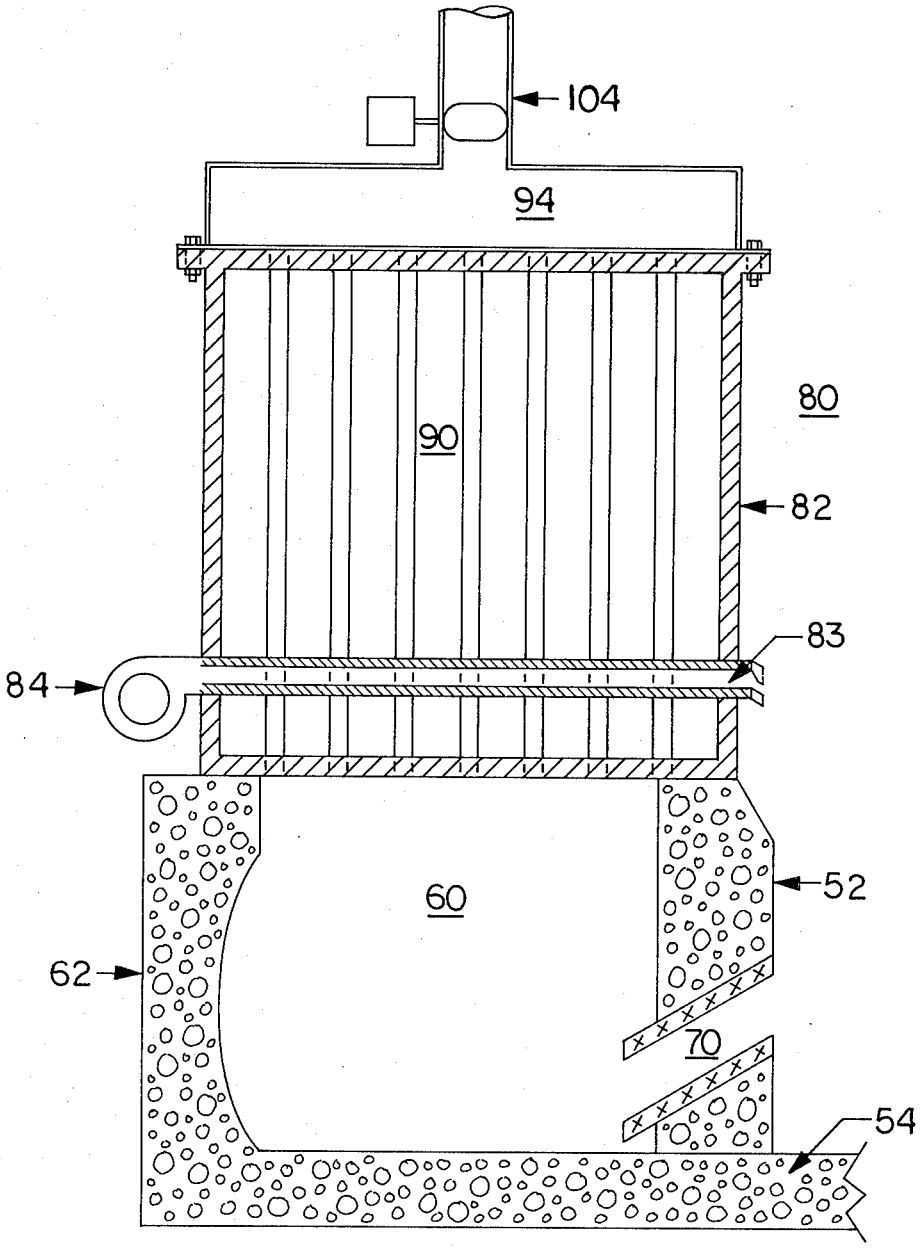
FIG. 4 is a partial front cross sectional view in the direction of the arrows 4—4 of FIG. 3 showing a secondary combustion zone 60, 70 at the lower level and heat exchange zone 90 at the upper level on one side of the furnace.

Referring specifically to FIGS. 2, 3 and 4, the quenching zone and primary combustion chamber are located centrally of the furnace along the center axis viewed in the elongate direction from front to back of the rectangular cross section. The quenching zone 80 above is defined by a water jacket 82 surrounding the quenching zone while the primary combustion zone or chamber below is defined by walls 52 of refractory insulating material. Wood-type fuel such as logs or sticks are generally inserted into the primary combustion chamber from above in a generally vertical orientation after removal of an air tight cover. Alternatively pieces of wood-type fuel of other shapes can be formed in a vertical stack extending into the quenching zone. The water jacket 82 surrounding the quenching zone 80 and forming part of the heat transfer environment upper level 40 prevents combustion of the portion of the fuel directly above the primary combustion chamber 50 and confines combustion to the base of the fuel. The water jacket 82 is made of metal for good heat transfer characteristics and contains the convection circulating heat transfer medium such as water which circulates through an inlet and outlet for example to an insulated water storage tank not shown.

On the other hand, the primary combustion chamber 50 is defined by walls 52 and base 54 made of an insulating refractory material. Examples of appropriate insulating refractory materials are found in U.S. patent application Ser. No. 075,815 referred to above.

The secondary combustion zones 60 enclosed by refractory walls 62, 52 and heat exchange zones 90 are positioned along the sides of the furnace outside but parallel to the quenching zone 80 and primary combustion zone 50. Narrower sections of the water jacket 82 may be provided at the ends of the furnace to define the ends of the quenching zone. Flue gas propagation delay pathways or holding channels 70 may comprise in the example illustrated four separate channels at the four quarters of the furnace through walls 52. Or, they may comprise two continuous or extended pathways extending longitudinally from the front to the back of the furnace on each side through walls 52. The different secondary combustion zones 60, channels 70, and heat exchange zones 90 are effectively four in number in the example of the furnace illustrated in FIGS. 1–5 because of the four different flue gas outlets and damper controls that are also provided. Thus, the furnace is functionally divided into four sectors for separate control of combustion in each sector as hereafter described.

Referring to FIG. 4, the four sectors of the furnace corresponding to the four quarters or corner portions of the rectangular furnace are established by the four different flue outlets 104, **104*a*, 106 and 106*a* respectively. Each of the sectors, corners or quarters of the furnace define potential exhaust outlet pathways for the products of primary combustion in chamber 50, according to whether the dampers 114, 114*a*, 116, 116*a* in the flue outlets 104, 104*a*, 106, 106*a*** respectively are opened or closed. The sector controlled operation of the furnace is subsequently more fully described.

Each flue gas propagation delay pathway or holding channel 70 or each channel portion 70 affords sufficient holding time or delay time in the high temperature refractory environment in combination with zones 60 to assure substantially complete combustion of the gaseous products of wood fuel burning. Suitable exemplary dimensions to this end are set forth in the U.S. patent application Ser. No. 075,815 referred to above. Whichever one or ones of the refractory channels or pathways 70 or whichever portions of the extended channels 70 are operative at any time for passage of flue gas is a function of the position of dampers in the multiple flue gas outlet pathways to the chimney 100.

The structural and refractory material walls 62 and base 64 defining the secondary combustion zone 60 also provide a base for supporting the heat exchange zone 90 above. The heat exchange zone 90 is defined by the metal water jacket 82 which contains the heat transfer medium. Running through the inside of the water jacket 82 and in heat exchange contact with the heat transfer medium are a plurality of fire tubes 92 having inlet ends opening into the secondary combustion zone 60 and outlets opening into a plurality of flue gas plenums positioned over the heat transfer environment 90 and leading to the outlet chimney 100. The metal fire tubes 90 conduct the hot end-products of substantially complete wood-type fuel combustion to the flue outlets. The extended surface area contact with the heat transfer medium, typically water, provides the heat exchange and heat transfer.

Figure 5:
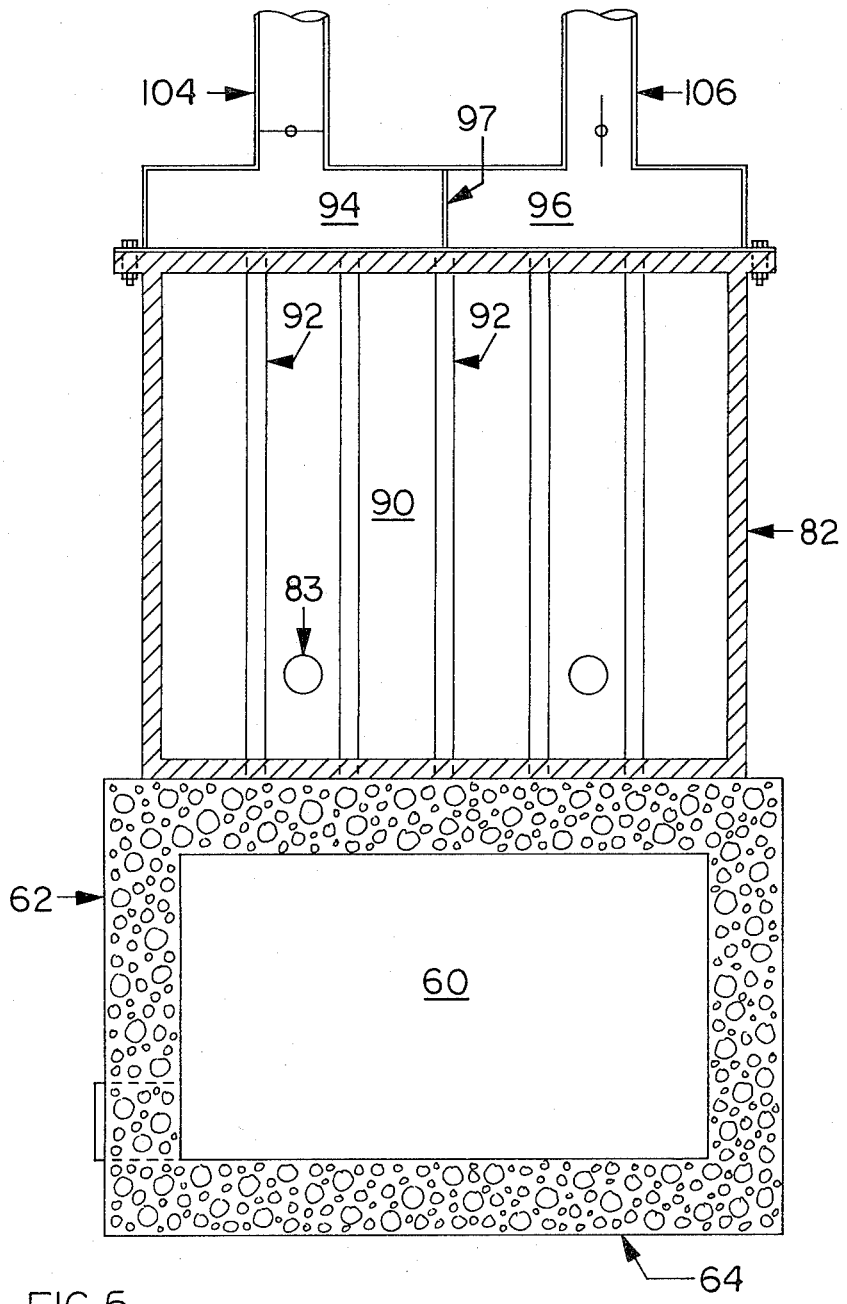
FIG. 5 is a side cross sectional view in the direction of the arrows 5—5 on FIG. 3 also showing the secondary combustion zone 60 at the lower level and heat exchange zone 90 at the upper level on one side of the furnace.

Referring to FIGS. 3 and 5 the fire tubes 92 on the left side of the furnace open at their outlet ends into either first or second flue gas plenums 94 and 96 separated by partition 97. Thus, flue gas exhaust collecting plenum 94 is located at the front left hand portion of the furnace 20 while flue gas collecting plenum 96 is located at the rear portion of the left side of the furnace.

Flue gas exhaust plenum 94 leads to outlet 104 while flue gas plenum 96 leads to outlet 106. Similarly on the other side of the furnace plenum 94A leads to outlet 104A and exhaust plenum 96A leads to flue gas exhaust outlet 106A. The flue gas end products of combustion exiting through outlets 104 and 106 run down conduit 102 to the chimney 100. Flue gas exhaust venting through outlets 104A and 106A on the other side of the furnace exit through conduit 102A to the chimney 100.

A feature and advantage of this arrangement is that the separate flue gas draft outlets 104, 106, 104A and 106A are separately controlled by individual motorized dampers 114, 116, 114A and 116A. By this expedient combustion of fuel in primary combustion chamber 50 can be controlled for combustion of different sectors of the fuel either simultaneously or sequentially, and for shifting the locus of combustion between different sectors of the fuel.

This can be seen by following the effective draft backwards through the furnace from the chimney 100. From chimney 100 the draft is effected or communicated through either of the four draft outlets 104, 106, 104A and 106A, each separately individually controlled by dampers 114, 116, 114A, and 116A. These dampers may be automatically or manually operated. In the present instance motorized dampers are used for automatic control.

Suppose for example that all of the dampers are closed except for the damper in outlet 104 which is open. Thus, the dampers are individually controlled and opened or closed in any combination and the instance in which one of the dampers alone is open, namely damper 114 in outlet 104 is here considered. With only draft outlet 104 open the draft is effectively limited to those fire tubes 92 which open into the plenum 94 communicating with flue gas outlet 104. In the present example this would be approximately one quarter of the total number of fire tubes in the furnace being those located in the front left hand quarter of the furnace. Fire tubes opening into plenums 96, 94A and 96A would not experience sufficient pressure differential to conduct significant amounts of the flue gas.

The pressure differential transmitted from the chimney through fire tubes 92 communicating with plenum 94 in turn draw flue gas from that portion or zone of the secondary combustion zones 60 in the front left hand quarter of the furnace. This in turn draws the products of primary combustion from wood fuel in combustion zone 50 through the flue gas channel 70 located at the front left hand quarter of the furnace or that portion of an elongated front to back pathway or channel 70 located at the front left hand quarter. This draft would in turn favor combustion of the fuel located in the front left hand corner of the primary combustion chamber or zone 50. The good draft at this portion of the fuel located in the primary combustion chamber and the primary combustion air drawn over this portion of the fuel favors and selects combustion at this sector.

The sector or location of favored combustion of the fuel can be shifted by control of the motorized dampers 114, 116, 114A and 116A controlling the four outlets in this example. Thus, the locus of combustion can be shifted around the fuel sequentially by sequential control of the motorized dampers. For example, dampers 114, 116, 114A and 116A may be opened and closed sequentially in that order for shifting the locus of combustion clockwise around the load of fuel. Alternatively all the dampers may be opened simultaneously or more than one but less than all the dampers may be opened simultaneously. By this expedient and by appropriate permutations and combinations of control of the flue gas outlets, the rate of combustion and heat output of the furnace may be controlled without sacrificing the efficiency and completely and high intensity of the combustion. Thus the present furnace affords the advantage of a high turn down ratio without sacrifice of intensity or efficiency, an objective not achieved by any known wood-type fuel furnace.

It is apparent that while in the examples of FIGS. 1 through 5, four separately controllable flue gas outlet pathways are shown, the number of flue gas pathways separately controllable, may be increased or decreased. Furthermore, each separately controllable flue gas outlet, in this instance 104, 106, 106A and 104A is provided with a separate charged air blower source 84, 86, 86A and 84A respectively for providing combustion air, and good mixing and turbulence in the corresponding sector. Each of the charged air blowers is associated with one of the controllable burning sectors of the furnace and provides the necessary air and turbulence for efficient combustion at that locus or sector. For example referring to FIG. 4 blower 84 delivers air through the air conduit inlet 83 into the primary combustion zone or chamber 50 at the front left quarter of the furnace.

Charged air blower 84 is controlled simultaneously with motorized damper 114 which in turn controls outlet 104. Thus, when motorized damper 116 is open then air blower 84 is actuated delivering combustion air into the front left quarter of the furnace. This air is drawn to the front left quarter and through the draft established at the flue gas pathway or channel 70 at the front left quarter of the furnace.

A portion of the air received through inlet 83 from blower 84 forms the primary combustion air to sustain primary combustion in the front left quarter of the furnace primary combustion chamber 50. Surplus air mixed with the products of primary combustion exit with the draft established through the propagation channel 70 which delays propagation for sufficient time to permit completion of combustion by the mixed air and gases in the refractory high temperature environment. Combustion is substantially complete before exiting through the fire tubes 92 leading to plenum 94 and the open outlet 104, in turn leading to the chimney 100. Thus, while only a sector of the charge of fuel is undergoing combustion, the combustion is at high intensity and to substantial completion. The rate of output of the furnace may thus be turned down without sacrifice of the efficiency or completeness of the wood fuel combustion.

Thus, sector control of a charge of fuel placed in the furnace is accomplished according to the state of the dampers at the multiple flue gas outlets distributed around the furnace and the corresponding charged air blowers. In the example of FIGS. 1 through 5 an elongate rectangular furnace is used with the primary combustion zone and quenching zone through which the fuel is fed to the primary combustion zone distributed axially along the center of the furnace. The secondary combustion zone and heat transfer zone affording multiple pathways for the flue gas are distributed along the outsides of the primary combustion zone. The multiple outlet pathways provided with separate draft control permit high intensity combustion of confined portions of the fuel without having to burn the entire base of the fuel at once. Furthermore, this localization of the intense fuel combustion enabled by the present invention may be sequentially shifted around the base of the fuel. More than one pathway may be opened at a time for increasing the size of the locus of combustion. Thus, anywhere from one to all of the multiple pathways available may be opened or controlled by any time for a high turn down ratio. By this expedient and by appropriate permutations and combinations of control of the flue gas outlets, the rate of combustion and heat output of the furnace may be controlled without sacrificing efficiency of the completeness and intensity of combustion.

In the embodiment of the present invention illustrated in FIGS. 6 through 10 there is shown a controlled combustion furnace of cylindrical or radial configuration for sector control of burning wood-type fuel at high efficiency and with high turn down ratio. The radial furnace illustrated in FIGS. 6 through 10 includes the same basic features of the invention illustrated with reference to the embodiment in FIGS. 1 through 5 however, the different geometrical configuration affords greater compactness of the functions in space and greater effectiveness and efficiency in the use of heat transfer surface areas in the heat transfer portion of the furnace.

Figure 6:
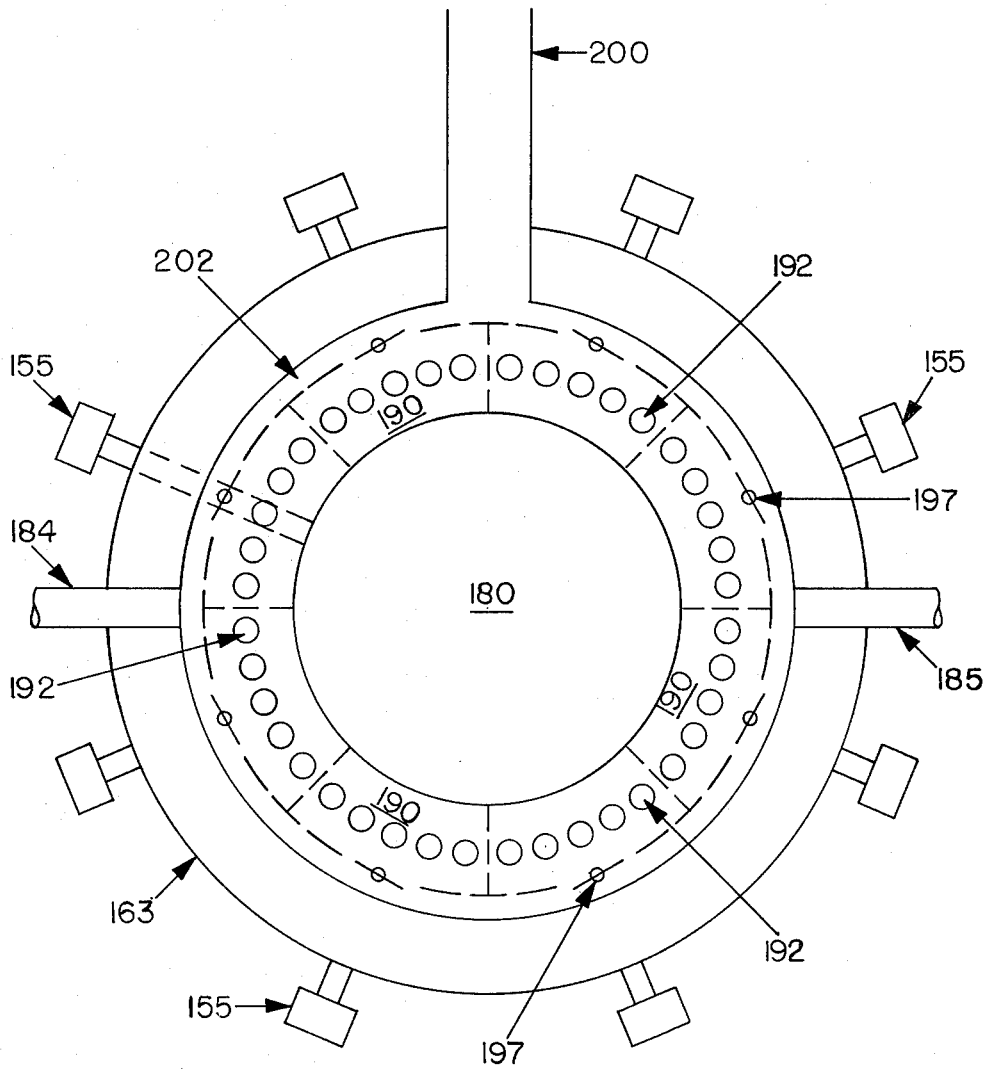
FIG. 6 is a top plan view of a cylindrical or radial, controlled combustion furnace for sector control of wood-type burning in accordance with the present invention showing the central location of the primary combustion zone and the quenching zone 180.
Figure 7:
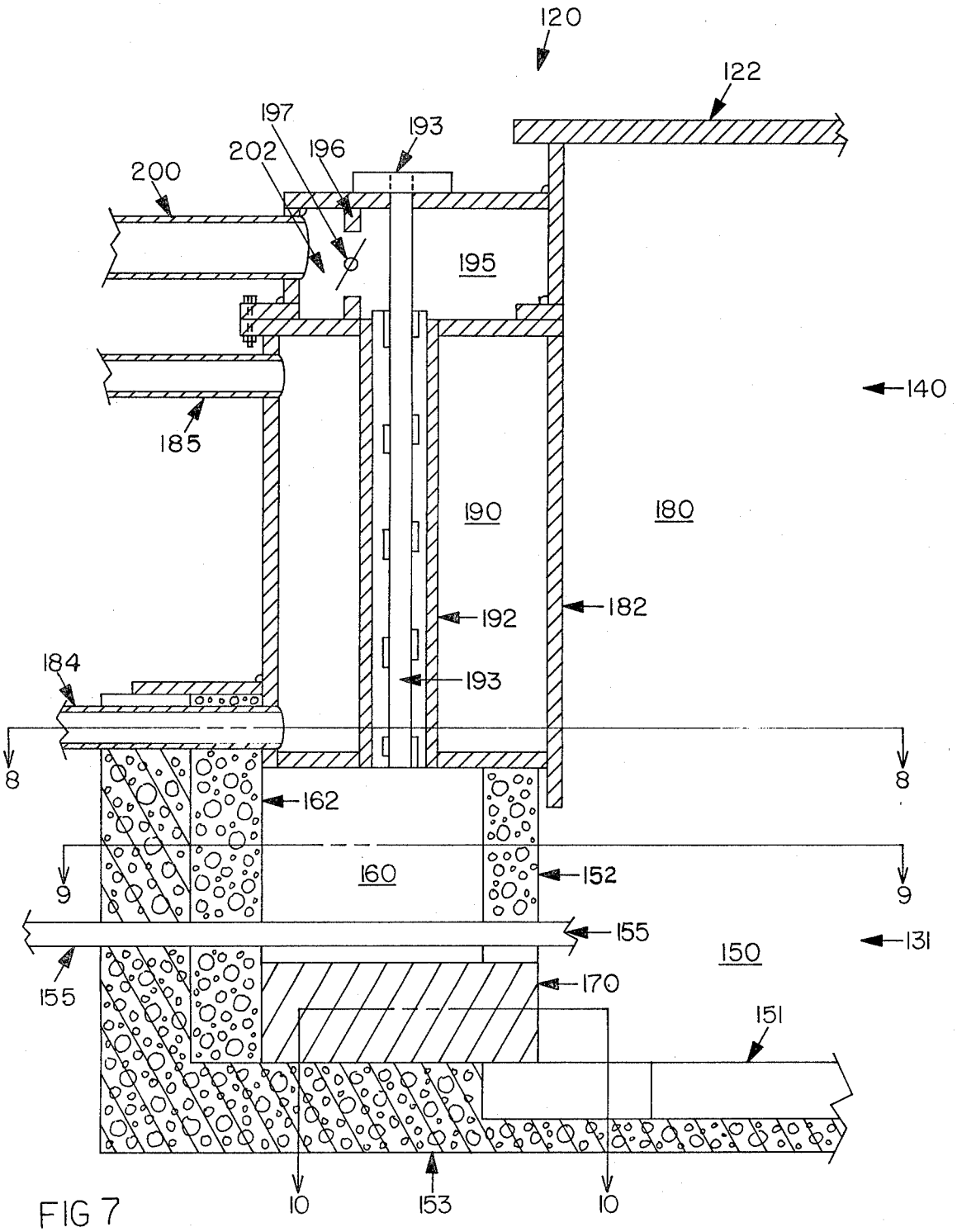
FIG. 7 is a partial side cross section through a side of the radial furnace showing the quenching zone 180, primary combustion zone 150, secondary combustion zone 160, 170 and heat exchange zone 190.

Referring to FIGS. 6, and 7, the furnace 120 is formed with a first level or lower level 131 comprising the refractory high temperature insulating environment including the primary combustion zone 150 and secondary combustion zone 160. The furnace is also formed with a second level or upper level 140 defining the relatively lower temperature heat transfer environment including both the quenching zone 180 and the heat exchange zone 190. The quenching zone 180 through which fuel in the form of logs, sticks, or other wood type fuel is fed into the combustion chamber is bounded by the water jacket 182 of metal material for good heat transfer characteristics. The water chamber 182 also contains the heat transfer medium such as water and defines the heat exchange zone 190 oriented coaxially around the quenching zone and fuel feed chamber.

Wood type fuel is placed in the chamber upon removal of the air tight cover 122 and is generally oriented in vertical attitude or stack with the base of the fuel resting in the primary combustion chamber 150. The base of the primary combustion zone or chamber 150 is formed by structural refractory bricks 151 capable of bearing the weight of a charge of vertically oriented wood pieces such as sticks or logs or a vertical stack. The sides of the primary combustion chamber are defined by an annular ring of refractory material forming side wall 152. The side wall 152 is spaced vertically from the base 151 of the primary combustion chamber by means of a plurality of horizontally spaced refractory bricks 161 which define multiple channels or pathways extending radially outwardly from the primary combustion zone to the secondary combustion zone 160. As seen more clearly with reference to FIGS. 9 and 10 in addition to FIG. 7 the bricks 161 define a plurality of radially extending sustained combustion pathways 170 in a high temperature environment distributed entirely around the combustion chamber. By this expedient, primary combustion products may be drawn off selectively from any radial sector of a charge of wood fuel contained in the primary combustion chamber as hereafter described.

The secondary combustion zone 160 is itself in the form of an annular ring chamber concentrically surrounding the primary combustion chamber and communicating with it through the plurality of radially extending pathways 170. The annular space of the secondary combustion zone is defined at the inside by the ring wall 152 of refractory high temperature insulating material and at the outside by a second larger diameter ring of refractory material forming the outer cylindrical wall 162. The base of the secondary combustion zone is formed by the structural refractory base 153 of the furnace which joins the refractory base 151 of the primary combustion chamber. It should be kept in mind that the primary combustion chamber communicates with the secondary combustion zone through the plurality of radially extending pathways beneath the annular wall 152 formed by the radially oriented spaced apart bricks 161.

Figure 8:
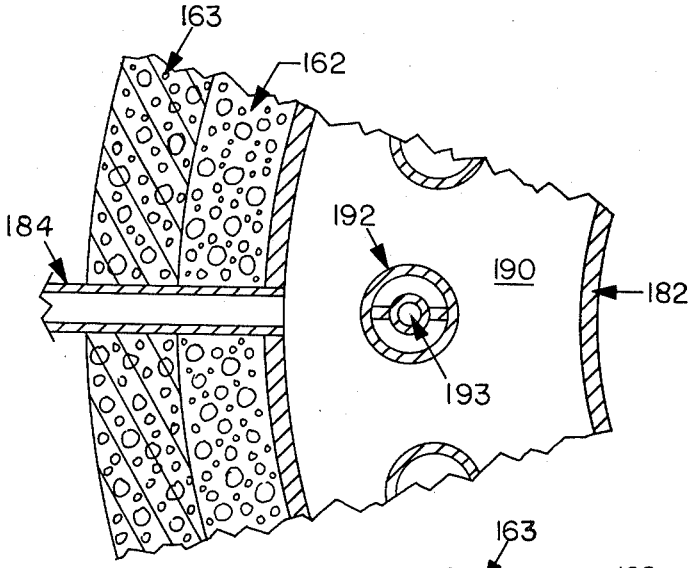
FIG. 8 is a partial cross sectional view looking down through the heat exchange zone 190 in the direction of the arrows on line 8—8 of FIG. 7.
Figure 9:
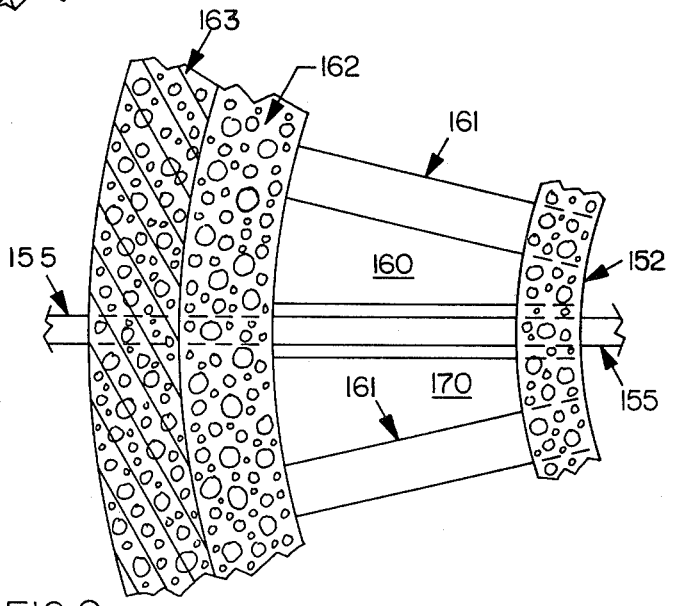
FIG. 9 is a partial cross sectional view looking down through the secondary combustion zone 160, 170 in the direction of the arrows on line 9—9 of FIG. 7.
Figure 10:
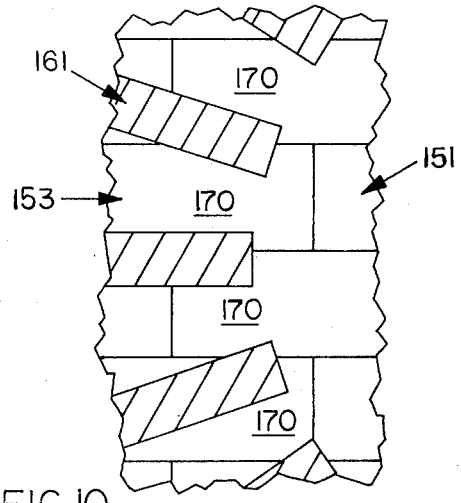
FIG. 10 is a partial cross sectional view looking down at the base of the furnace in the direction of the arrows on line 10—10 of FIG. 7.

The inner and outer annular ring walls 152 and 163 defining the secondary combustion zone also form the base for the heat exchange zone 190. Thus, the heat exchanger which is an integral part of the water jacket 182 sits over and is supported on the secondary combustion zone walls. From the secondary combustion zone the end products of combustion at high temperature pass through a plurality of flame tubes or heat exchange tubes 192 distributed radially around the furnace. Thus, the flame tubes 192 are distributed over the secondary combustion zone and outside and concentrically around the quenching zone 180. The flame tubes 192 pass directly through the water jacket 182 in which circulates the heat transfer medium, typically water. As shown in FIGS. 7 and 8, each of the flame tubes 192 is provided with a turbulator 193 which produces turbulent flow of flue gases as the flue gas passes through the flame tube thereby enhancing heat exchange with the circulating heat transfer medium.

An important feature of the invention is that one or more flame tubes 192 are associated with each sector flue propagation channel 170 leading from the primary combustion chamber to the secondary combustion zone. Thus, flue gases leaving any particular sector of the burning fuel are associated with the draft of a particular flame tube or flame tubes. Each flame tube 192 or set of flame tubes 192 associated with a particular sector and flue gas pathway 170 exits into a sector of the plenum or smoke chamber 195 which is partitioned off from adjacent sectors. Each such smoke chamber 195 includes a separate exhaust outlet 196 in which is operatively positioned a motorized or other automatically controlled damper 197 to control the draft through the particular sector of the furnace. Each of the outlets 196 leads to a common annular chimney plenum 202 communicating with the common chimney outlet 200.

Further associated with each sector of the furnace as defined by the plurality of radial pathways 170 leading from the primary combustion zone and the plurality of flue chambers 195 and outlets 196 is a charged air source including a blower not shown and inlet tube 155 which delivers combustion air under pressure into the primary combustion chamber 150 at the locus of associated flue propagation channel 170.

In the operation of the furnace at a high turn down ratio the locus of combustion is confined to a single sector or restricted location at the base of the charge of fuel resting at the bottom of primary combustion chamber 150. In order to so confine the locus of combustion, the damper 197 which may be an automaticaly controlled or motorized damper at the outlet 196 of sector smoke chamber 195 is opened. The draft from the chimney 200 is therefore communicated thru chimney plenum 202 to the fire tube or fire tubes 192 associated with the respective smoke chamber sector 195. This, in turn communicates through secondary combustion chamber 160 with a particular flue gas propagation delay channel 170 into a limited sector of the base of the fuel. In addition, combustion air is provided under pressure through air inlet 155 at the location of the sector in question. A confined combustion therefore takes place with charged air and draft localized at a particular sector at the base of the wood fuel.

The dampers 197 radially distributed around the furnace may thereafter be sequentially controlled for opening successive dampers with the remainder closed. In this manner the locus of wood fuel combustion may be urged around the furnace for example in a clockwise direction consuming the fuel in a controlled and selective manner with localized combustion and high intensity. By this expedient a high turn down ratio is possible while still maintaining high efficiency combustion. Alternatively, all of the motorized dampers 197 may be open to permit simultaneous combustion throughout the base of the fuel resting in the primary combustion chamber 150.

Hot exhaust gas drawn from the primary combustion chamber through the sector associated with the open draft is mixed with excess air received through charged air inlet 155 for completion of combustion in the high temperature refractory environment afforded by the flue propagation channel 170 and secondary combustion chamber zone 160. The end products of combustion at high temperature thereafter passed through the flame tubes 192 where they contact the extended surface area and heat exchange with the circulating heat transfer medium. Thus, water circulates through inlet and outlet 184, 185 for convection circulation through the water jacket 182 and then to an insulated water storage tank not shown, all as further described in U.S. patent application Ser. No. 075,815. In either of the furnace configurations according to the invention, an actively induced shaft is advantageously provided by a blower installed, for example at the chimney.

A feature and advantage of the radial configuration furnace in accordance the present invention is that the quenching of possible combustion of a charge of fuel stored in the quenching zone 180 and the heat exchange or heat transfer of heat from the hot gaseous end products of combustion takes place at the same chamber, namely water jacket 182. In this respect the radial configuration furnace provides for effective use of space and eliminates the necessity of two convection circulating chambers, one for the quenching and heat transfer from the fuel magazine and second for exchange of heat from the flue gas exhaust. By means of the cylindrical furnace the zones and chambers may be concentrically arranged and serve dual purposes at the interfaces.

In summary the radial or cylindrical configuration furnace comprises a plurality of sectors distributed around the circumference of the primary combustion chamber and defined by a plurality of radially extending flue gas pathways leading from the primary combustion zone to the secondary combustion zone. Thereafter a plurality of separate flame tubes are associated with each of the sectors leading to a respective plurality of smoke chambers or plenums partitioned and separated from each other. Each smoke chamber or plenum in turn leads to a separate flue gas outlet to the common chimney with a separate damper control at each outlet. Thereby the draft from the chimney can be separately controlled and communicated to each of the sectors sequentially or simultaneously.

I claim:

1. A furnace for controlled combustion of wood-type fuels comprising:

a primary combustion chamber comprising a refractory base portion for high temperature combustion of wood type fuels and an upper portion with water jacket means in heat exchange relation therewith for transferring heat to a heat transfer medium and quenching combustion in the upper portion of said primary combustion chamber;

a plurality of refractory secondary combustion channel pathways leading away from the refractory base portion of the primary combustion chamber for high temperature secondary combustion of flue gases derived from different sectors of fuel contained in the primary chamber;

a plurality of flue draft pathway heat exchange means leading from said secondary combustion channel pathways for transfer of heat from the end products of combustion to the heat transfer medium;

and draft control means for separately controlling the draft through each secondary combustion channel pathway and flue draft pathway heat exchange means for sector control of combustion of fuel in the primary combustion chamber thereby affording a high turn down ratio and permitting sequential burning of controlled sectors of fuel contained in said primary combustion chamber.

2. A furnace as set forth in claim 1 wherein the primary combustion chamber is of circular cross-section configuration and wherein the plurality of refractory secondary combustion channel pathways comprise separate channels distributed around the periphery of the primary combustion chamber along radial directions from the center of the primary combustion chamber, wherein said water jacket means coaxially surrounds an upper portion of said primary combustion chamber and wherein said plurality of flue draft pathway heat exchange means pass through the water jacket means in heat exchange relation with a heat transfer medium therein.

3. The furnace of claim 1 wherein said primary combustion chamber comprises a central chamber, said plurality of refractory secondary combustion channel pathways comprise portions of a laterally extended channel distributed around the refractory base portion of the primary combustion chamber extending radially away from the central chamber, said water jacket means extends coaxially around the upper portion of the central chamber, and the plurality of flue draft pathway heat exchange means pass through the coaxial water jacket means in heat exchange relation.

4. The furnace, as set forth in claim 2 or 3, further comprising an annular refractory combustion zone formed coaxially around the refractory base portion of the primary combustion chamber, said plurality of refractory secondary combustion channel pathways connecting the central chamber with said annular refractory combustion zone, said plurality of flue draft pathway heat exchange means extending from the annular combustion zone through said water jacekt means.

5. The furnace of claim 4 further comprising an annular smoke chamber around the upper portion of the primary combustion chamber for collecting the end products of combustion from the plurality of flue draft pathway heat exchange means and for venting the end products to a common chimney.

6. The furnace of claim 2 or 3 wherein the plurality of refractory secondary combustion channel pathways comprise an annular array of sectors distributed around the refractory base portion of the primary combustion chamber, said sectors extending radially away from the primary combustion chamber.

7. The furnace of claim 6 further comprising a refractory annular combustion zone positioned coaxially around the refractory base portion of the primary combustion chamber, said sectors connecting the refractory base portion and annular combustion zone.

8. The furnace of claim 1 wherein the primary combustion chamber further comprises forced air inlet means for admitting air under pressure for turbulent mixing and swirling of air with gaseous products of wood-type fuel combustion.

9. The furnace of claim 1 wherein said primary combustion chamber is formed with elongate configuration having two sides, wherein said plurality of refractory secondary combustion channel pathways are distributed along the sides of said combustion chamber leading from the refractory base portion, said water jacket means constructed and arranged along at least the upper portion of the sides of the primary combustion chamber, and said plurality of flue draft pathway heat exchange means passing jacket means in heat exchange relationship.

10. The furnace of claim 9 further comprising first and second elongate refractory combustion zones along the sides of the primary combustion chamber adjacent the refractory base portion, said plurality of refractory secondary combustion channel pathways leading to said first and second elongate combustion zones, said plurality of flue draft pathway heat exchange means leading from said first and second zones through the water jacket means.

11. The furnace of claim 10 wherein said plurality of combustion channel pathways comprise separate channels.

12. The furnace of claim 10 wherein said plurality of combustion channel pathways comprise portions of a laterally extending channel.

13. The furnace of claim 10 further comprising exhaust plenum means constructed and arranged for collecting the end products of combustion from the plurality of flue draft pathway heat exchange means and venting the end products to a chimney.

14. The furnace of claim 9 wherein said elongate primary combustion chamber comprises a horizontal log bed constructed and arranged for receiving a stack of horizontal logs which feed by gravity into the locus of combustion in the refractory base portion.

15. The furnace of claim 9 wherein said secondary combustion channel pathways comprise a plurality of separate refractory secondary combustion channels leading away from the refractory base portion of the primary combustion chamber.

16. The furnace of claim 9 wherein said secondary combustion channel pathways comprise portions of a laterally distributed channel leading away from extended portions of the periphery of the refractory base of the primary combustion chamber.

17. The furnace of claim 1 further comprising flue draft plenum means for collecting the end products of combustion from the plurality of flue draft pathway heat exchange means and for venting same.

18. The furnace of claim 17 further comprising induced draft fan means operatively positioned in said draft plenum means for inducing a draft from the primary combustion chamber.

19. The furnace of claim 1 further comprising timer means operatively coupled to said draft control means for sequential and controlled burning of different sectors of fuel contained in the primary combustion chamber.

20. The furnace of claim 1 wherein said draft control means comprise a plurality of dampers operatively coupled to said plurality flue draft pathway means.

21. The furnace of claim 20 wherein said dampers comprise motorized dampers.

22. The furnace of claim 21 further comprising timer means operatively coupled to control said motorized dampers for sequential burning of different sectors of fuel contained in the primary combustion chamber.

23. The furnace of claim 1 wherein the plurality of flue draft pathway heat exchange means comprise metal fire tubes which pass through the water jacket means and are coupled at one end respectively to the refractory secondary combustion channels.

24. The furnace of claim 23 further comprising a plurality of turbulators positioned in said fire tubes.

25. A furnace for controlled combustion of wood-type fuels comprising:

a first level comprising a refractory high temperature insulating environment defining a primary combustion zone forming the locus of wood-type fuel combustion and a secondary combustion zone for completion of burning of flue gases;

a second level comprising a relatively low temperature heat transfer environment defining a quenching zone and a heat exchange zone, said second level comprising a heat transfer medium circulating in enclosure means, said second level positioned over the first level;

fuel holding and feeding means passing through said second level quenching zone to the first level primary combustion zone for gravity feed of wood-type fuel into the locus of fuel combustion while quenching combustion of fuel held over the locus of combustion;

flue draft pathway means constructed arranged in operative relationship with said first and second levels for venting flue gas from the secondary combustion zone of the first level through the heat exchange zone of the second level for extracting heat from the end products of combustion;

draft inducing means for inducing a draft from the first level through the second level in said flue draft pathway means;

means for admitting combustion air into the primary combustion zone;

said secondary combustion zone comprising a plurality of secondary combustion pathways distributed over the primary combustion zone and leading from the primary combustion zone for high temperature and complete secondary combustion of flue gases derived from different sectors of fuel received in the primary combustion zone from the fuel holding and feeding means;

said flue draft pathway means comprising a plurality of separate flue draft pathways leading from the plurality of first level secondary combustion pathways through the second level heat exchange zone;

and a plurality of draft control means for separately controlling the draft through each flue draft pathway and hence each secondary combustion pathway for sector control of combustion of fuel in the primary combustion zone thereby affording a high turn-down ratio while still maintaining high temperature efficient and complete combustion of the fuel.

* * * * *